US011136686B2

(12) United States Patent
Tripathy et al.

(10) Patent No.: US 11,136,686 B2
(45) Date of Patent: Oct. 5, 2021

(54) METHODS AND SYSTEMS FOR ALUMINUM ELECTROPLATING

(71) Applicant: BATTELLE ENERGY ALLIANCE, LLC, Idaho Falls, ID (US)

(72) Inventors: Prabhat K. Tripathy, Ammon, ID (US); Guy L. Fredrickson, Idaho Falls, ID (US); Eric J. Dufek, Ammon, ID (US); Laura A. Wurth, Ferndale, WA (US); J. Stephen Herring, Idaho Falls, ID (US)

(73) Assignee: BATTELLE ENERGY ALLIANCE, LLC., Idaho Fall, ID (US)

( * ) Notice: Subject to any disclaimer, the term of this patent is extended or adjusted under 35 U.S.C. 154(b) by 0 days.

(21) Appl. No.: 15/744,022

(22) PCT Filed: Jul. 15, 2016

(86) PCT No.: PCT/US2016/042528
§ 371 (c)(1),
(2) Date: Jan. 11, 2018

(87) PCT Pub. No.: WO2017/011761
PCT Pub. Date: Jan. 19, 2017

(65) Prior Publication Data

US 2018/0209057 A1 Jul. 26, 2018

Related U.S. Application Data

(60) Provisional application No. 62/193,376, filed on Jul. 16, 2015.

(51) Int. Cl.
*C25D 3/66* (2006.01)
*C25D 3/44* (2006.01)
(Continued)

(52) U.S. Cl.
CPC ..... *C25D 3/66* (2013.01); *C25D 3/44* (2013.01); *C25D 5/50* (2013.01); *C25D 17/04* (2013.01);
(Continued)

(58) Field of Classification Search
CPC ... C25D 3/66; C25D 3/44; C25D 5/50; C25D 17/04; C25D 17/10; C25D 21/02; C25D 21/12; C25C 3/06–24
See application file for complete search history.

(56) References Cited

U.S. PATENT DOCUMENTS 2,373,320 A * 4/1945 Lovell ..... C25C 3/06 205/376
2,510,128 A 6/1950 Miner, Jr. et al.
(Continued)

FOREIGN PATENT DOCUMENTS

CN 102766891 A 11/2012
CN 103397357 A 11/2013
JP 2004035911 A 2/2004

OTHER PUBLICATIONS

Galopin, et al., "Molten Salts in Metal Treating: Present Uses and Future Trends," Electrodeposition and Surface Treatment, vol. 3, pp. 1-31 (1975).
(Continued)

*Primary Examiner* — Ciel P Contreras

(57) ABSTRACT

Systems and methods for coating a metallic component are provided. In one embodiment, a metallic coating may be disposed in a plating bath comprising AlBr3. The metallic coating may be coupled with, or configured as, a working
(Continued)

electrode. A counter electrode formed of aluminum may be disposed within the plating bath. An electric current may be applied between the two electrodes resulting in the electrodeposition of aluminum on the metallic component. In one particular embodiment, the plating bath may include LiBr, KBr and CsBr, with $AlBr_3$ being present in an amount of approximately 80 percent or greater by weight. Various types of metals may be coated with aluminum using embodiments of the present disclosure. Additionally, the methods and systems described herein are amenable to coating of complex geometries.

33 Claims, 8 Drawing Sheets

(51) Int. Cl.

| | |
|---|---|
| ***C25D 17/04*** | (2006.01) |
| ***C25D 5/50*** | (2006.01) |
| ***C25D 17/10*** | (2006.01) |
| ***C25D 21/02*** | (2006.01) |
| ***C25D 21/12*** | (2006.01) |

(52) U.S. Cl.
CPC ..... *C25D 17/10* (2013.01); *C25D 21/02* (2013.01); *C25D 21/12* (2013.01)

(56) References Cited

U.S. PATENT DOCUMENTS

| | | | | |
|---|---|---|---|---|
| 2,762,764 | A * | 9/1956 | Owen | C25D 3/66 205/138 |
| 3,267,008 | A * | 8/1966 | Smith | C01F 7/58 205/138 |
| 3,268,422 | A | 8/1966 | Smith et al. | |
| 4,146,438 | A * | 3/1979 | de Nora | C25B 11/04 205/43 |
| 4,995,948 | A * | 2/1991 | Poa | C25C 3/34 204/241 |
| 5,242,563 | A | 9/1993 | Stern et al. | |
| 2004/0262163 | A1 * | 12/2004 | Nitta | C25D 3/66 205/67 |
| 2006/0154084 | A1 * | 7/2006 | Schuh | C25D 3/66 428/426 |
| 2009/0301886 | A1 * | 12/2009 | Hoshi | C25D 3/44 205/50 |

OTHER PUBLICATIONS

Tripathy, et al., "Aluminum Electroplating on Steel from a Fused Bromide Electrolyte," Surface & Coatings Technology, vol. 258, pp. 652-663 (2014).

PCT International Search Report for PCT International Patent Application No. PCT/US2016/042528, dated Nov. 1, 2016.

* cited by examiner

METHODS AND SYSTEMS FOR ALUMINUM ELECTROPLATING

CROSS-REFERENCE

This application claims priority to U.S. Provisional Patent Application No. 62/193,376, entitled METHODS AND SYSTEMS FOR ALUMINUM ELECTROPLATING, filed on Jul. 16, 2015, the disclosure of which is incorporated herein by reference in its entirety.

GOVERNMENT RIGHTS

This invention was made with government support under Contract Number DE-AC07-05ID14517 awarded by the United States Department of Energy. The government has certain rights in the invention.

BACKGROUND ART

The use of metals in industry is ubiquitous. For example, steel, aluminum, and aluminum alloys represent a large bulk of the structural materials used in industry throughout the world. The use of these materials has been extensive in many industries including, for example, shipping, aerospace, construction, mining, petroleum and automotive. One reason that such materials are used so often is that they are relatively inexpensive in comparison to alternatives. Additionally, these materials have multiple combinations of useful engineering criteria that are often required for their successful deployment in various applications. However, one challenge faced by industry when using various metallic materials, including steel, aluminum and aluminum alloys, includes the mitigation of corrosion.

Corrosion, particularly in highly corrosive environments such as those that contain free chloride ions (for example groundwater and underground mining activities), is a major challenge that many industries face. Although steel, aluminum and aluminum alloys may provide some degree of resistance to corrosive attack in relatively milder corrosive service conditions (e.g., stainless steel gets passivated due to the formation of chromium oxide, $Cr_2O_3$, on its surface and aluminum very easily forms a tenacious oxide layer, $\gamma$-$Al_2O_3$, on its surface), they can, and often do, fail in moderate-to-severe corrosive environments. Depending on the application, failure of these materials can sometimes be catastrophic.

Metallic coatings, used on foundational metal components (e.g., on an aluminum plate or a steel fastener) have been shown to provide suitable corrosion resistance and improved physicochemical properties and such coatings are routinely used for corrosion mitigation purposes. Metallic coatings can be broadly divided into two categories, noble (e.g., Ag, Cr, Sn, Ni) and sacrificial (e.g., Al, Zn. Cd). In the steel industry, Zn, Cd and Cr have been extensively used as corrosion-mitigating agents. Although both cadmium and hexavalent chromium coatings provide excellent corrosion resistance characteristics, use of these metals is being phased out because of their environmental toxicity (cadmium) and carcinogenic effect (chromium).

From a corrosion mitigation standpoint, metallic aluminum provides an excellent combination of properties. Besides being relatively inexpensive, metallic aluminum has been found to be an effective corrosion barrier, particularly for steels. Although aluminum, being more reactive than steel, can be used as a sacrificial anode to protect steel in a corrosive environment (e.g., in submerged marine structures such as oil platform, ship hulls, etc.), it can also be used to coat steel to provide the corrosion protection due to its excellent oxide forming ability. In industry, aluminum coating is carried out by a variety of processes including hot dipping, thermal spraying, sputter deposition, vapor deposition and electrodeposition processes. From among these techniques, electrodeposition provides several advantages, such as relatively ease of operation and the possibility of obtaining uniform, thick, adherent and smooth coating even on complex objects with adjustable microstructure/morphological features and controlled thickness. However, the comparatively larger negative standard electrode potential of Al/Al(III) couple (−1.67 Volts vs. a standard hydrogen electrode (SHE)) precludes its deposition from aqueous baths.

Two known processes based on the organic solvents for electrodeposition of aluminum are in commercial operation. These processes are known as the SIGAL process and the REA1 process. Although quality aluminum (Al) coatings may be obtained by these two processes, these processes suffer from a series of disadvantages such as a narrow electrochemical window, lower conductivity, lower solubility of aluminum salts, and loss of electrolyte because of the higher volatility and electrolyte flammability. As a consequence, the application of these solvent systems is limited.

Room temperature ionic liquids (RTILs) have also been proposed for preparing aluminum coatings. Although these solvents offer some excellent characteristics, such as higher electrical conductivity, a wider electrochemical potential window, negligible vapor pressure and non-flammability, they are expensive and require careful storage, making them unsuitable for larger batch-sized operations.

A third category of solvents, also known as high temperature molten salts, have been used to electrodeposit aluminum on a variety of substrates. Alkali chloride salts (NaCl—KCl, $AlCl_3$—NaCl, and $AlCl_3$—NaCl—KCl) offer some advantages over the RTILs. A molten chloride salt (NaCl/NaCl—KCl), containing 70-80 wt. % $AlCl_3$, has been successfully used to electroplate aluminum at an operating temperature of approximately 180° C.

The use of a binary electrolyte ($AlCl_3$—NaCl) has been reported to form a dull, coarsely-grained Al layer with poor anti-corrosion properties. Although several metals (such as tin, lead, zinc, manganese, bismuth, copper, silver, cadmium, gallium, indium and germanium) were added to the binary electrolyte in order to improve the quality of the Al layer, only tin, lead and manganese were found to have effectively improved the deposit quality. However, in the presence of these metals, the coating invariably was an alloy of aluminum. Despite significant progress made in the preparation of the Al coating from the chloride melts, one of the unsolved issues has been to develop new electrolyte systems in order to prevent the significant loss of $AlCl_3$ while also obtaining a high quality pure aluminum (non-alloyed) coating.

The addition of reactive chemicals, such as tetramethyl ammonium chloride (0.5-2.0 wt. %) to the $AlCl_3$—NaCl—KCl electrolyte has reportedly been attempted in an effort to bring down the concentration of $AlCl_3$ to about 50 mol. % and to prevent the loss of $AlCl_3$. However, no data on the vaporization loss of $AlCl_3$ is known to have been reported.

There is a need for the development of suitable methods and non-chromium/cadmium based materials to mitigate corrosion on various metallic components including steel, aluminum, aluminum alloys, zirconium, zirconium alloys and other metals and metal alloys.

SUMMARY OF INVENTION

In accordance with the present disclosure, various embodiments of methods and systems for coating a metallic substrate are provided. For example, in accordance with one embodiment, a system is provided comprising a primary crucible containing a plating bath, the plating bath comprising $AlBr_3$. The system further includes an electrode assembly comprising a working electrode including a metallic workpiece, and a counter electrode comprising aluminum.

In one embodiment of the invention, the plating bath further comprises LiBr, KBr, and CsBr. In one embodiment, the plating bath is a homogenous mixture. In one particular embodiment, the plating bath does not exhibit a eutectic melting point temperature. In accordance with one embodiment, the $AlBr_3$ is present in the plating bath in an amount of approximately 80 percent by weight or greater.

In one embodiment, the system additionally includes a secondary crucible, wherein the primary crucible is disposed at least partially within an interior volume of the secondary crucible. In one embodiment the primary crucible is electrically insulated from the secondary crucible.

In one embodiment, a support member is disposed within the interior volume of the secondary crucible, the primary crucible being positioned on the support member.

In one embodiment, the system further includes a heater that is located and configured to heat the plating bath contained within the primary crucible.

In one embodiment, the system includes a furnace well, wherein the secondary crucible is positioned within a lower interior portion of the furnace well.

In one embodiment, a first heat baffle is positioned between the lower interior portion of the furnace well and an upper interior portion of the furnace well.

In one embodiment, the system further includes a chamber associated with the furnace well and a second heat baffle that is located between an upper portion of the furnace well and the chamber.

In one embodiment, a cooling system, or at least a portion thereof (e.g., cooling coils) is positioned adjacent a portion of furnace well and adjacent the second heat baffle.

In one embodiment, the system may further comprise a potentiostat operably coupled with the electrode assembly. The system may further include a computer operably coupled with the potentiostat.

In one embodiment, the metallic workpiece may comprise any of a stainless steel, mild steel, tool steel, aluminum, zirconium, neodymium-iron-boron, nickel-titanium, copper or brass material.

In accordance with another embodiment of the present disclosure, a method of coating a metal component is provided. The method comprises providing a plating bath comprising $AlBr_3$, coupling a metal component with a working electrode, disposing the metal component at least partially within the plating bath, disposing a counter electrode at least partially within the plating bath; and depositing a coating of aluminum on a surface of the metal component including applying a voltage difference between the working electrode and a reference electrode while maintaining a current flow between the working electrode and the counter electrode.

In one embodiment, providing the plating bath includes providing a plating bath that does not exhibit a eutectic melting point.

In one embodiment, the act of providing a plating bath comprising $AlBr_3$ further includes providing a plating bath comprising LiBr, KBr, and CsBr. In one embodiment, the plating bath is configured to contain approximately at least 80 percent by weight $AlBr_3$.

In one embodiment, the plating bath is maintained at a temperature of approximately 325° C. to approximately 350° C. during the deposition of the aluminum.

In one embodiment, the metal component is provided to comprise at least one of a stainless steel, mild steel, tool steel, aluminum, zirconium, neodymium-iron-boron, nickel-titanium, copper or brass material.

In one embodiment, the metal component is provided with a complex surface geometry.

In one embodiment, providing a plating bath includes heating a mixture of LiBr, KBr, and CsBr to a temperature of approximately 750° C. or greater to provide a ternary eutectic melt, cooling the ternary melt to a temperature of approximately 100° C. or less, adding the $AlBr_3$ to the ternary melt and heating the $AlBr_3$ and ternary melt to form a homogenous melt.

In one embodiment, the method further comprises annealing the coating of aluminum. In one particular embodiment, annealing the coating of aluminum includes heating the coating of aluminum to a temperature of approximately 600° C. or greater.

Features, acts techniques or components described herein with respect to one embodiment may be combined with those of other embodiments without limitation. These and other aspects and features will be ascertained in further examination of the description and drawings set forth herein.

BRIEF DESCRIPTION OF DRAWINGS

The foregoing and other advantages of the invention will become apparent upon reading the following detailed description and upon reference to the drawings in which.

BEST MODE(S) FOR CARRYING OUT THE INVENTION

Figure 1:
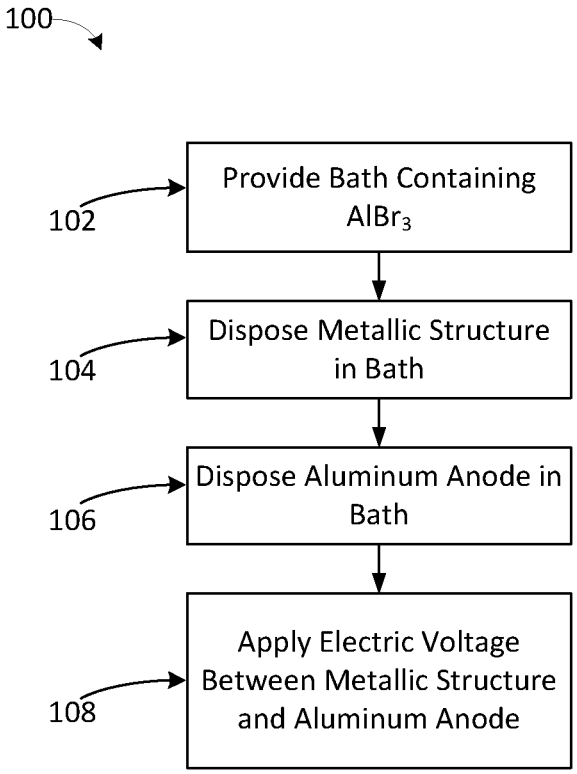
FIG. 1 is flowchart depicting a method of electroplating a metallic workpiece according to an embodiment of the present disclosure.

Embodiments of the present disclosure provide methods and systems for electroplating metallic structures (e.g., mild steel, stainless steel, tool steel, aluminum, aluminum alloys, zirconium, zirconium alloys, copper, brass). Referring first to FIG. 1, a method 100 is provided for electroplating a metallic structure. The method 100 includes providing a bath comprising $AlBr_3$ as indicated at 102. A metallic structure that is to be coated is placed at least partially within the bath as indicated at 104. As noted above, the metallic structure may include any of a variety of metals and may also include simple or complex geometric components. An aluminum anode is also placed in the bath as indicated at 106. It is noted that the order of disposing the metallic structure and the aluminum anode within the bath may be reversed, or they may be both disposed within the bath simultaneously. With both the metallic structure and the aluminum anode being disposed within the bath, an electric current may be applied between the metallic structure and the aluminum anode as indicated at 108, resulting in the electrodeposition of an aluminum coating on the metallic structure. Further details of the method 100 depicted in FIG. 1 will be set forth below, including examples of electrodeposition of an aluminum coating on various types of metallic components.

Figure 2:
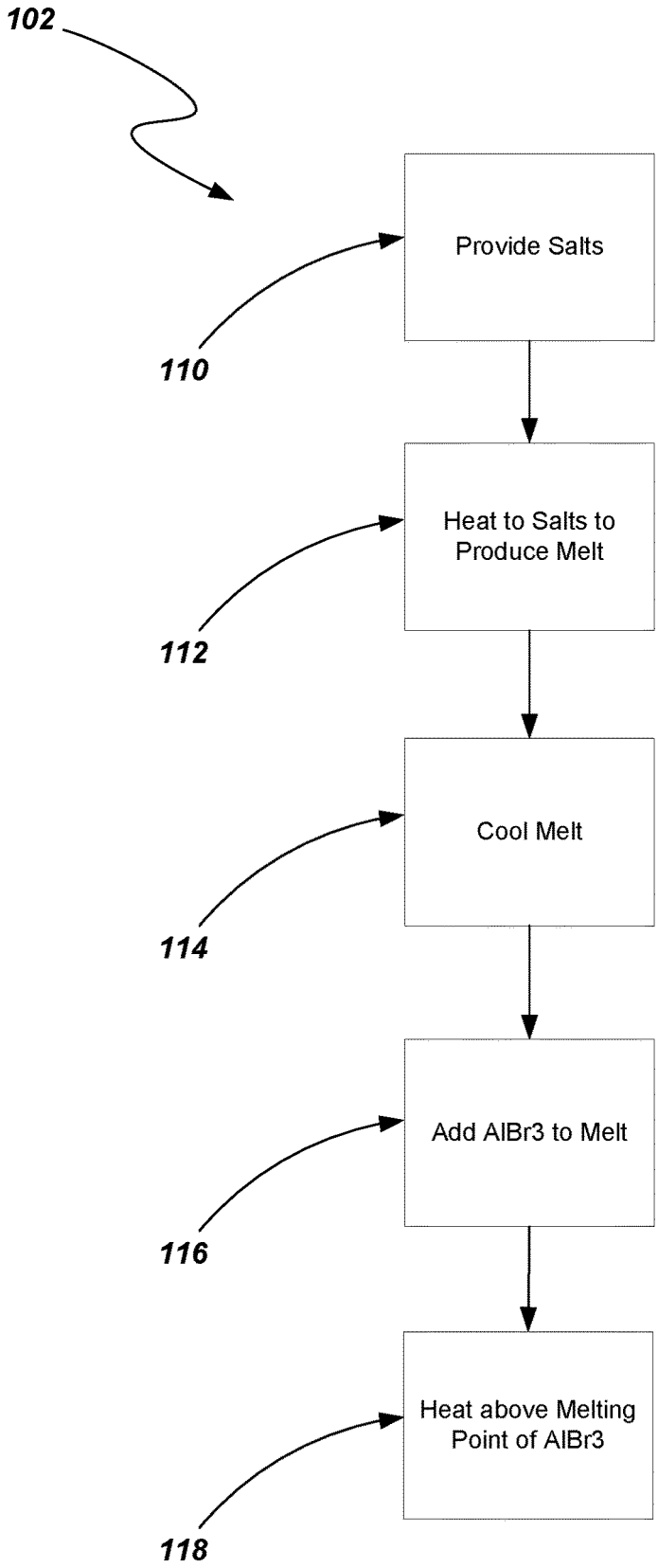
FIG. 2 is a flowchart depicting a method of preparing a bath or a melt for use in an electroplating method and system according to an embodiment of the present disclosure.

Referring to FIG. 2, in one embodiment, the act of providing a bath comprising $AlBr_3$ as indicated at 102, may include providing a plurality of salts as indicated at 110. Such salts may include, for example, LiBr, KBr, and CsBr. These salts may then be combined and heated to produce, for example, a melt (e.g., a ternary eutectic melt) as indicated by 112. For example, the salts may be heated to a temperature of approximately 750° C. or greater (the melting point of KBr being approximately 734° C., the melting point of CsBr being approximately 636° C., and the melting point of LiBr being approximately 550° C.). The resulting melt may then be cooled as indicated at 114. For example, the melt may be cooled to a temperature of approximately 100° C. or less. A quantity of $AlBr_3$ may then be added to the ternary melt, as indicated at 116, and the melt may then be slowly heated to a temperature at or above the melting point of $AlBr_3$, as indicated at 118. In one example, the melt may be heated to a temperature of about 350° C. to prepare a homogenous melt.

Figure 3:
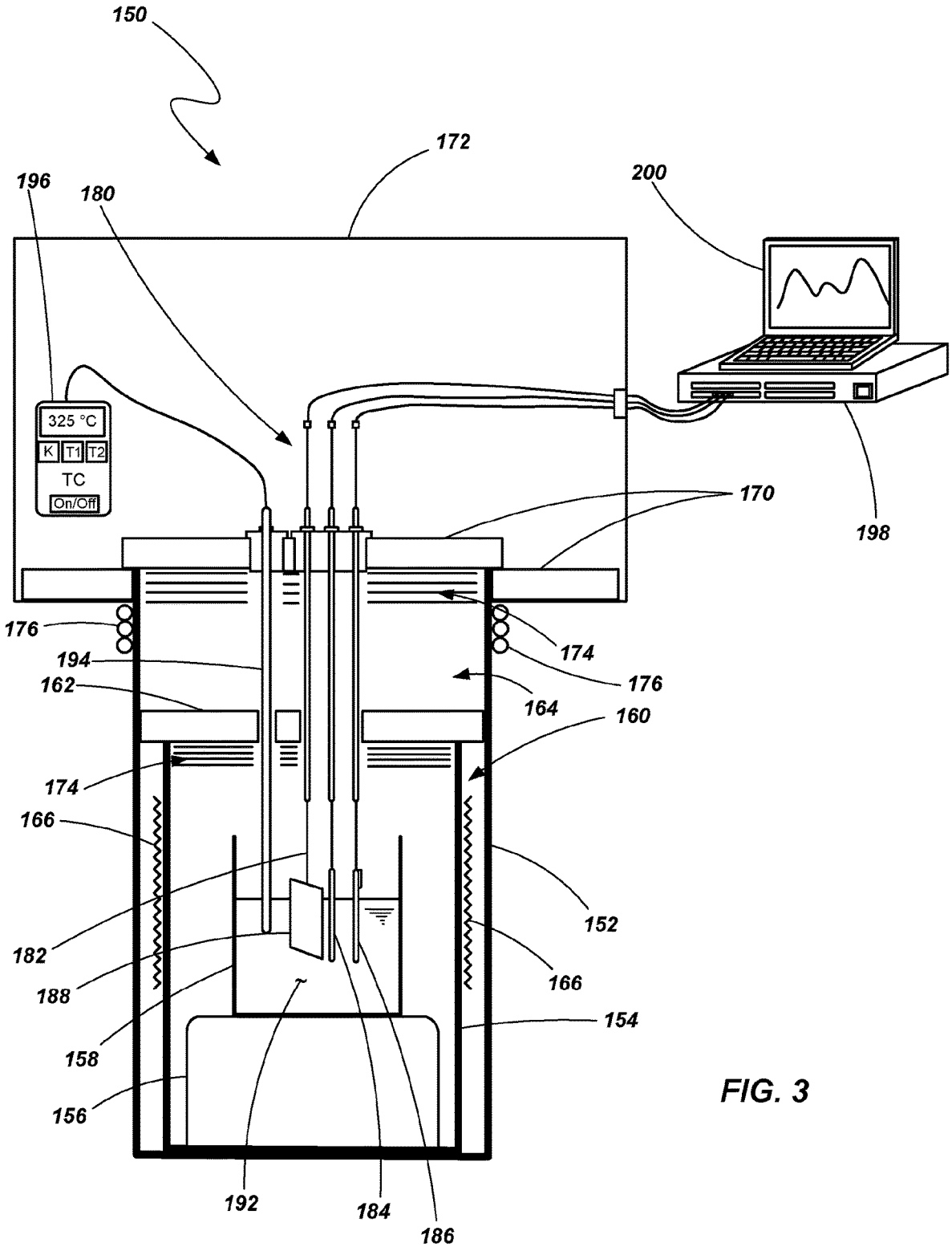
FIG. 3 is a schematic of a system for use in electrodeposition of an aluminum coating on a metallic workpiece according to an embodiment of the present disclosure.

Referring to FIG. 3, a system 150 for coating or plating metallic components with aluminum is shown in accordance with one or more embodiments of the present disclosure. The system 150 includes a furnace well 152 which, in one embodiment, may be formed of a stainless steel material. A secondary crucible 154 may be disposed within the furnace well. In one embodiment, the secondary crucible 154 may also be formed of a stainless steel material. One or more support members 156 may be disposed within the secondary crucible 154 to support a primary crucible 158. The support member 156 may be formed, for example, of a material such as aluminum-silica. The support member 156 may provide electrical insulation of the primary crucible 158 from the secondary crucible 154 and the furnace well 152. In one embodiment, the primary crucible 158 may be formed of an alumina material. In another embodiment, the primary crucible may be formed of a nickel material.

The secondary crucible 154, support member 156 and primary crucible 158 may be positioned within a lower portion 160 of the furnace well 152 with a heat baffle 162 separating such components from an upper portion 164 of the furnace well 152. A heater may be used to heat various components. In one example, resistance heating elements 166 may be positioned adjacent to a portion of the secondary crucible 154 and/or a portion of the furnace well 152 in order to provide sufficient heat to the primary crucible 158 during operation of the system. Of course a variety of different types of heaters or heating systems may be used in conjunction with the present disclosure.

A second heat baffle 170 may be positioned between the upper portion of the furnace well 152 and a glove box or other chamber 172. In one embodiment, the chamber may be formed of a material such as stainless steel and be filled with argon or some other inert gas to provide a controlled atmosphere. In various embodiments, heat shields 174, such as copper heat shields, may be associated with the heat baffles 162 and 170. A coolant system may include, for example, coolant lines 176 positioned against a portion of the furnace well (e.g., adjacent a portion of the upper portion 164 between the first set of heat baffles 162 and the second set of heat baffles 170) to insulate the glove box 172 and other components from the heat associated with the electrodeposition process that takes place in the lower portion of the furnace well 152.

An electrode assembly 180 may include a working electrode 182, a reference electrode 184 and a counter electrode 186. The working electrode 182 comprises, or is otherwise coupled with, a work piece 188. While the workpiece 188 is shown generally as a plate, it may include a variety of other components including structures having complex geometries. In one embodiment, the working electrode 182 may be formed of a material comprising stainless steel, with the reference electrode 184 being formed as a glassy carbon rod, and the counter electrode 186 may be formed as an aluminum rod. In one embodiment, the three electrodes 182, 184 and 186 may be held in position by an aluminum plug 190 or other suitable structure such that they each extend down into a bath or melt 192 contained within the primary crucible 158. The aluminum plug 190 may support other components as well, such as a temperature sensor or other data acquisition equipment. In one embodiment, the temperature sensor may include a thermocouple 194 extending into the bath or melt 192, the thermocouple 194 being coupled with an output device 196 to provide an instantaneous read-out or display of the temperature of the melt 192.

The electrodes 182, 184 and 186 may be coupled with a potentiostat 198 or other instrumentation to control the operation of the electrodes, including controlling the voltage difference applied between the working electrode 182 and the reference electrode 184. A computer 200 or other controller may be associated with the potentiostat 198 for controlling the voltage and for obtaining data associated with the performance of the electrode assembly 180.

As noted above, the bath or melt 192 may include a molten alkali bromide salt. Molten alkali bromide salts have qualities and characteristics amenable to addressing known processing issues associated with other aluminum plating processes such as those that use organic solvents, room temperature ionic liquids, or high temperature molten chlorides. The liquidus temperature range for binary and ternary alkali bromide salts is in the range 226-328° C. Such a temperature range permits the formation of an aluminum coating on a variety of substrates including, but not limited to, precipitation-hardened aluminum, mild steel, stainless steel, zirconium based alloys (e.g., zirconium-tin alloys including zircaloy 2 and zircaloy 4, zirconium-niobium, neodymium-iron-boron, nickel-titanium, copper, brass and a variety of other thermally-sensitive materials. Moreover, using $AlBr_3$ as the functional electrolyte, provides distinct advantages in terms of relatively lower operating temperatures (e.g., the melting point of $AlBr_3$ is lower than that of, for example, $AlCl_3$) and in terms of less volatility loss (e.g., the boiling point of $AlBr_3$ is higher than that of, for example, $AlCl_3$). Additionally, alkali bromides are non-flammable and have ionic conductivities similar to or exceeding those of the ionic liquids and/or organic plating baths.

In preparing a solution for further coating experiments, various experiments were conducted to determine various characteristics of eutectic salt compositions using $AlBr_3$ as discussed below.

Preparation of the salt samples (for melting) required careful consideration because of the extremely low melting point of the $AlBr_3$ (98° C.) as compared to LiBr (550° C.), KBr (734° C.) and CsBr (636° C.). In a first approach, a eutectic salt mixture was first heated (in a small alumina crucible) to approximately 750° C. in order to prepare the melt. The eutectic melt was cooled to approximately 100° C. before $AlBr_3$ was added. The salt mixture was then slowly heated up to approximately 350° C. to prepare a homogeneous melt. The furnace was then switched off in order to cool the melt to room temperature. The percentage weight change of various compositions is set forth below in Table 1.

TABLE 1

| Salt Composition | Weight change before the addition of $AlBr_3$ (wt. %) | Weight change after the the addition of $AlBr_3$ (wt. %) |
|---|---|---|
| Eutectic Salt mixture (ESM) | 0.11 | — |
| ESM + 10 wt. % $AlBr_3$ | 0.03 | 0.009 |
| ESM + 20 wt. % $AlBr_3$ | 0.04 | 0.04 |
| ESM + 30 wt. % $AlBr_3$ | 0.04 | 0.08 |
| ESM + 40 wt. % $AlBr_3$ | 0.03 | 0.23 |
| ESM + 50 wt. % $AlBr_3$ | 0.04 | 0.23 |
| ESM + 60 wt. % $AlBr_3$ | 0.04 | 0.5 |
| ESM + 70 wt. % $AlBr_3$ | 0.05 | 0.42 |
| ESM + 80 wt. % $AlBr_3$ | 0.04 | 0.72 |
| ESM + 90 wt. % $AlBr_3$ | 0.03 | 1.02 |

In the second approach, $AlBr_3$ was added to the powdered salt mixture. The mixture was then heated slowly and the temperature was held at 150° C. for about an hour before raising the temperature to the final value of 750° C. where the melt was homogenized for a duration of about 30 min. The furnace was then switched off in order to cool the melt to room temperature. This procedure was conducted only for the condition of a salt mixture containing 20 wt. % $AlBr_3$. The percent weight change after the addition of $AlBr_3$ in this case was 0.49.

It was observed from these weight changes that in case of the second procedure, the percentage weight loss was approximately 12 times higher than that of the value obtained in the first approach. Subsequently, all the salt samples for the melting point determination were prepared first by melting the eutectic salt samples up to 750° C., cooling the molten salt samples up to 100° C. before adding the $AlBr_3$ and raising the temperature to approximately 350° C. The solidified salt samples, obtained in the second stage, were taken up for the determination of the melting points using differential scanning calorimetry (DSC). Table 1 (above) shows that the percent weight loss remained almost constant before the addition of $AlBr_3$. Additionally, Table 1 shows that, at higher concentrations of $AlBr_3$ (e.g., greater than about 50 wt. % $AlBr_3$), higher weight loss was primarily because of the loss of $AlBr_3$ by way of volatilization.

The melting point of the ternary electrolytes, containing calculated amounts of $AlBr_3$ (5-90 wt. %), was determined using a Netzsch DSC setup, model STA 449 F3. The salt samples were prepared in an argon atmosphere glove box and sealed in gold-coated steel crucibles by applying a torque in the range 2.4-2.8 Nm. Thermograms from the Netzsch DSC setup were analyzed with Proteus® Thermal Analysis software.

About 80-100 g of salt mixture was melted in an alumina crucible. The electrodes 182, 186, and 188 with adjusted heights, were lowered into the melt and the coating experiments were carried out by varying the operating temperature (325-400° C.), electrolysis time (5-180 min), current density (0.1-1.5 A $cm^{-2}$) and $AlBr_3$ content (10-90 wt. %). Fundamental electrochemical measurement (with transient techniques) preceded the applied coating measurements.

Phase analysis of the solidified electrolyte (LiBr—KBr—CsBr—$AlBr_3$), prior to coating experiments, was carried out using a powder x-ray diffraction (XRD) technique using a PANalytical Empyrean X-ray Diffractometer at room temperature. The samples for powder XRD measurements were prepared in a small box furnace, placed inside an argon atmosphere controlled glove box where the moisture and oxygen levels were less than 0.1 ppm and 1.2 ppm respectively. Such a measure was adopted to prevent any type of contamination of the salt mixture by the atmospheric air/moisture given the extreme hygroscopic nature of these salts. The solidified salt samples were homogenized in the glove box, mounted on a sample holder and covered with a Mylar film before being exposed to the X-ray beam for recording the diffractograms. Such a procedure was effective in preventing the solidified electrolyte from getting exposed to the atmospheric air/moisture.

DSC thermograms of the eutectic LiBr—KBr—CsBr salts (noted as a eutectic composition—EC in Table 2 below), containing 10-90 wt. % $AlBr_3$, suggested a decreasing trend in the melting temperatures with each incremental addition of $AlBr_3$ as shown in Table 2 below. For each sample, three heating and cooling cycles were run and the average of the three values (obtained from the heating curves) was recorded as the melting temperature.

TABLE 2

| Composition (wt. %) | Eutectic MP (° C.) | Liquidus temp. (° C.) |
|---|---|---|
| EC + 10 wt. % $AlBr_3$ | 240.2 | 331.7 |
| EC + 20 wt. % $AlBr_3$ | 239.8 | 330.0 |
| EC + 30 wt. % $AlBr_3$ | 238.7 | 325.3 |
| EC + 40 wt. % $AlBr_3$ | 238.9 | 323.7 |
| EC + 50 wt. % $AlBr_3$ | 239.4 | 317.0 |
| EC + 60 wt. % $AlBr_3$ | 239.4 | 313.4 |
| EC + 70 wt. % $AlBr_3$ | 236.7 | 311.9 |
| EC + 80 wt. % $AlBr_3$ | Absent | 310.7 |
| EC + 90 wt. % $AlBr_3$ | Absent | 302.6 |

The DSC measurements of the multi-component system showed some interesting observations. Samples containing 10-70 wt. % $AlBr_3$ showed both eutectic and liquidus temperatures, whereas samples containing 80 wt. % and 90 wt. % $AlBr_3$ compositions showed just the liquidus temperature. The absence of the eutectic temperature in these two compositions (with 80 wt. % and 90 wt. % $AlBr_3$) suggested that the melting process formed a more homogenous melt which perhaps can function as a better plating composition—something that was subsequently observed to be true.

It is noted that several authors have reported that the melting temperatures of the chloride salts containing 80 wt. % $AlCl_3$ was as low as 160° C. Contrary to the expectation, the melting temperature of the eutectic bromide salt, containing 80 wt. % $AlBr_3$, was observed to be greater than 300° C. Such a scenario might have arisen because of the formation of higher melting complex species (single or multiple).

In order to examine the possible phase formation in the quaternary melt, two representative salt samples (containing 10 wt. % and 80 wt. % $AlBr_3$ respectively) were examined by powder XRD technique. All the peaks in the XRD profile of LiBr—KBr—CsBr-10 wt. % $AlBr_3$ could not be identified as the JCPDS data (from the International Center of Diffraction Data) did not match with the existing phases in the Li—K—Cs—Al—Br system. Some of the phases that could be identified in the pattern include LiBr, KBr, and CsBr. Presence of phases such as $CsAlBr_4$ and/or $Cs(AlBr_4)$, to a lesser extent, was indicated. Also, $KAlBr_4$ may have been present as a very minor phase.

No $AlBr_3$ phase was determined to be present. This may be because of the chemical reaction of $AlBr_3$ with alkali bromide salts resulting in the formation of complex species of the general formula, $MAlBr_4$ (M=Li/Na/K/Cs). It is noted that the formation of Al complexes in chloride melts, containing higher amounts of $AlCl_3$ (>60 wt. %), have been reported in literatures. However, to the inventors' knowledge, no such information on the formation of Al-complexes, in the melts containing relatively lower amounts of $AlCl_3$, is provided in available literature. In the present case, formation of traces of $CsAlBr_4$ and/or $Cs(AlBr_4)$ was observed in the ternary melt containing as low as 10 wt. % $AlBr_3$.

The DSC measurements were followed up by the fundamental electrochemical measurements. These studies were carried out by dissolving 0.5-1 wt. % $AlBr_3$ in the ternary melt. The deposition and stripping mechanisms of $Al^{3+}$, in the ternary melt, were carried out using a three-electrode set up with a tungsten wire as the working electrode, a molybdenum wire as the counter electrode and glassy carbon rod as the pseudo reference electrode. The analyte ($AlBr_3$) was kept in the molten eutectic melt for several hours prior to recording the electrochemical data in order to ensure its maximum solubility in the eutectic melt.

Figure 4:
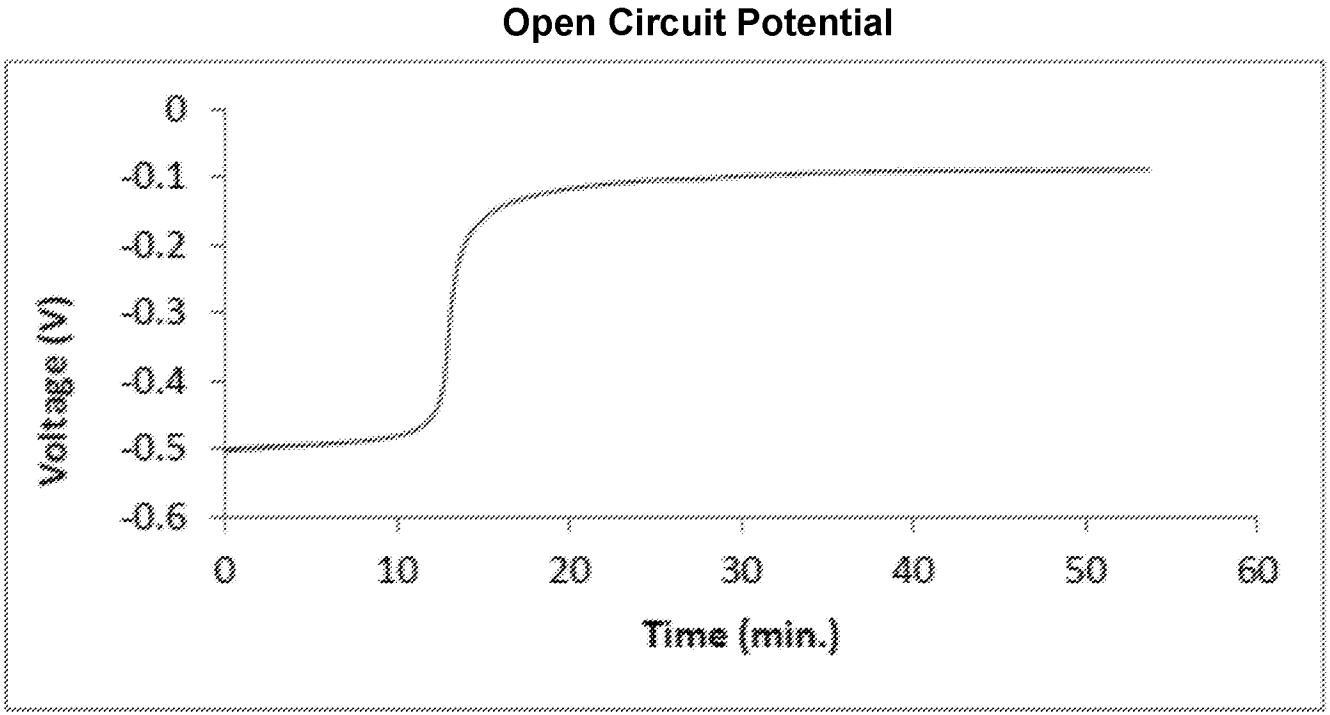
FIG. 4 shows a graph of the open current potential (OCP) of a plating bath in accordance with an embodiment of the invention.

The open circuit potential of a freshly prepared melt containing 0.5 wt. % $AlBr_3$ shows that the rest potential of the cell could be obtained within 30 min as seen in FIG. 4.

Transient electrochemical techniques (cyclic voltammetry, chronopotentiometry, chronoamperometry, and square wave voltammetry) were employed to study the mechanism of deposition and dissolution characteristics of the $Al^{3+}$ in eutectic LiBr—KBr—CsBr melt. The results of such tests indicate that that the deposition and dissolution of $Al^{3+}$ took place in just one step as compared to indications of such requiring two steps in a NaCl—$AlCl_3$ melt. The deposition and dissolution characteristics (or insoluble-soluble exchange phenomenon) were also observed to be reversible in nature. An open circuit potential, recorded right after the deposition of Al on working electrode for a duration of 3-5 minutes, suggests that Al did not form any alloy with tungsten as the potential was observed to fall rapidly and proceed to the open circuit value.

Examples

The following coating experiments were conducted using a quaternary melt including $AlBr_3$.

About 80-100 g of the eutectic salt mixture (LiBr—KBr—CsBr), used as the supporting electrolyte, was first melted in the alumina crucible. The crucible, containing the solidified salt, was cooled to approximately 100° C. $AlBr_3$ was incrementally added to this mixture with a view to preparing the final plating bath. The salt mixture containing $AlBr_3$ was slowly heated up to approximately 200° C. and kept at that temperature for several hours to minimize the vaporization loss of $AlBr_3$. Then the temperature was slowly raised to the plating temperature (approximately 325-350° C.) for electrodeposition of aluminum on the substrates. The salt mixture, upon melting, provided a depth (electrolyte height) of approximately 5-6 cm high which was adequate to plate various substrates. An aluminum rod (95% pure Al and 5 mm dia.) and a glassy carbon rod (100 mm long and 3 mm dia.) were used as the counter and reference electrodes, respectively.

The electroplating experiments were carried out by varying the operating temperature (between approximately 325° C. and approximately 400° C.), the cathode current density (CCD—between approximately 0.1 $Acm^{-2}$ and approximately 1.5 $Acm^{-2}$), the $AlBr_3$ content in the electrolyte (between approximately 10 wt. % and approximately 80 wt. %), and the duration of the electroplating (between approximately 5 minutes and approximately 80 minutes).

Initial experiments were carried out to determine acceptable levels of concentration of $AlBr_3$ in the melt in order to obtain a good and homogeneous deposit. For these experiments both 316 stainless steel (SS316) and 304 stainless steel (SS304) plates were chosen as the substrate material. Prior to carrying out the electroplating experiments, both the working electrode (the cathode) and counter electrode (an aluminum rod) were electrochemically cleaned by running the cyclic voltammetry (CV) at least 10 times and reversing the polarity each time. The cleaning of the cathode helped prepare the cathode for the subsequent coating process. The anode cleaning helped remove any adsorbed surface oxide layer on the surface of the aluminum as aluminum is known to very easily form a surface oxide layer. After each coating run, the cathode was pulled out of the plating bath in order to examine the formation of coating and other deposits on it. Each coating run preceded the measurement of an open circuit potential (OCP), also known as open circuit voltage (OCV), in order to allow the electrochemical cell to attain its rest potential. An OCP measurement showed that the rest potential of the electrochemical cell, prior to coating, in most of the experiments, did attain a constant value (in millivolts) after approximately 30 minutes.

Initial coating experiments were carried out for durations of up to 60 minutes at various cathode current densities containing $AlBr_3$ in the range 10-50 wt. %. At 10 wt. % $AlBr_3$, no deposits/coatings were found on SS304 plates at various CCDs when the plating experiments were carried out for different durations, ranging up to 1 hour. Although compositions containing 20 wt. % $AlBr_3$ did show some aluminum deposits, the coatings were found to be not satisfactory. For example, during subsequent water washings, the aluminum deposits settled at the bottom of the crucible such that no aluminum coating remained on the substrate. At higher current densities massive aluminum deposits were formed on the cathode but, upon subsequent water cleaning, the deposits again left no coating on the surface. Also at higher currents densities and upon prolonged electrolysis, thinning of the aluminum working electrode was observed.

Coating runs, using a SS304 plate as the substrate material, were continued with higher amounts of $AlBr_3$ in the plating bath. Plating experiments with 30-50 wt. % $AlBr_3$, at various CCDs and for different durations, resulted in the formation of massive aluminum deposits, which upon washing got settled at the bottom of the crucible and the coating got washed off from the SS304 substrates.

At 60 wt. % $AlBr_3$, electrolysis experiments showed a mixture of deposits and coatings. However, the coating did not get washed off after the water wash. At 70 wt. % $AlBr_3$, the deposit quality improved somewhat but was still not entirely satisfactory as the deposit was observed to not exhibit uniform thickness all across the covered surface and there were areas where either there was not much aluminum coating or the coating was very thin.

Figure 5:
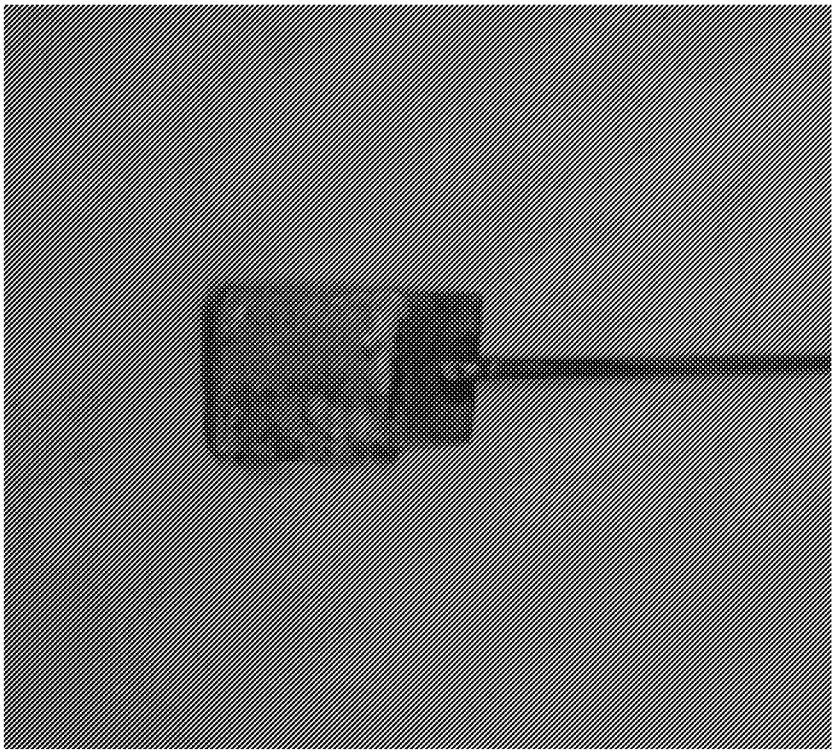
FIG. 5 is a photo of a 316 stainless steel sample with an aluminum coating show a salt deposit over the aluminum coating.
Figure 6:
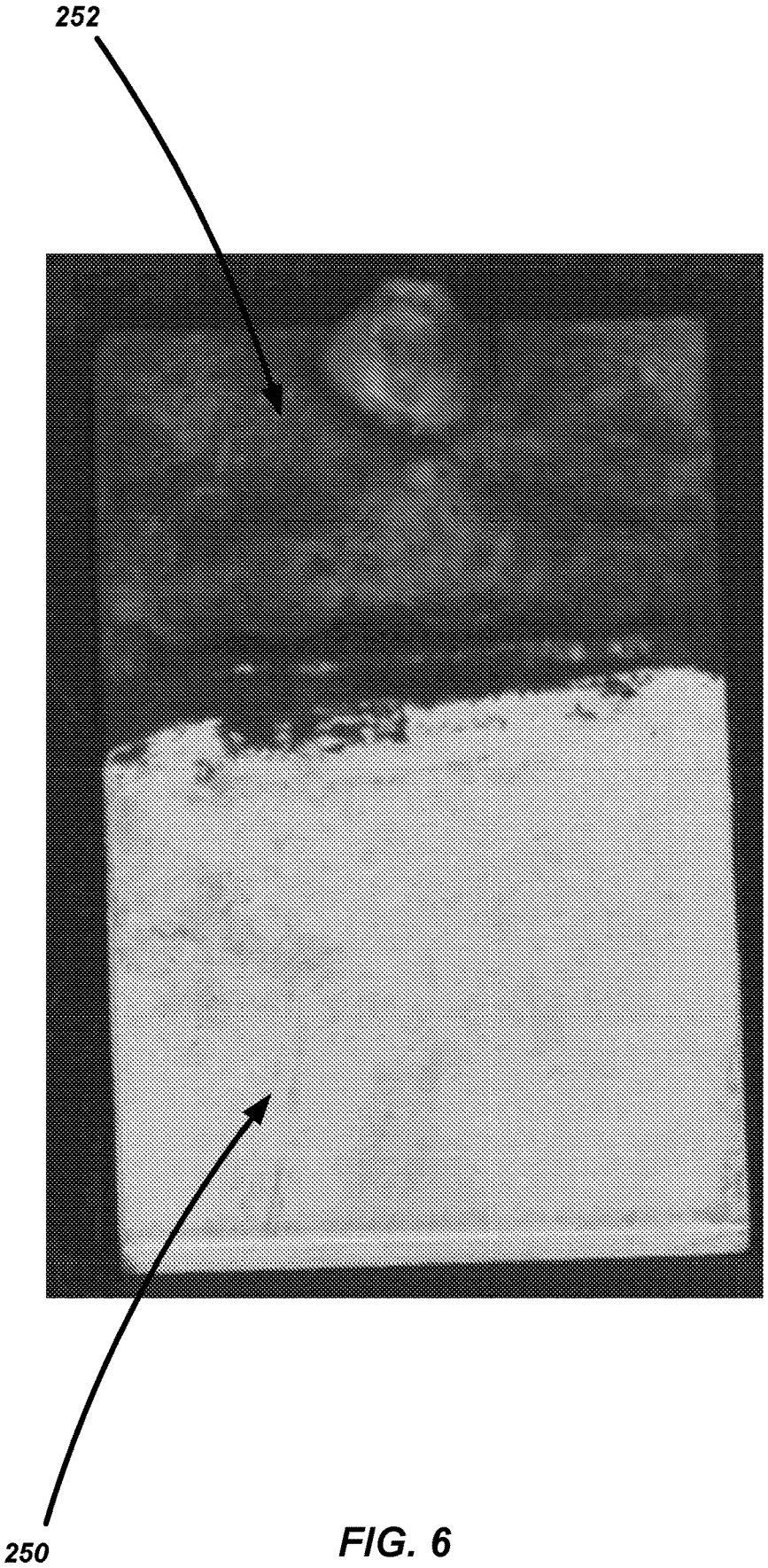
FIG. 6 is a photo of the 316 stainless steel sample shown in FIG. 5 after washing of the sample.

Experiments were carried out with 80 wt. % $AlBr_3$ in the melt. The OCP of the freshly prepared plating bath containing 80 wt. % $AlBr_3$ showed a very low rest potential prior to the coating experiment. A SS316 plate was first used as the substrate. Two sets of constant current plating (at −0.5 A and −0.8 A respectively) were performed on this substrate for 80 minutes each time for a total duration being 160 minutes. The substrate was removed from the bath after each electrolysis and it was observed, on both the occasions, that the substrate had nice coatings without the deposition of any aluminum dendrites on it. The cooled plate showed some minor salt deposit on it as seen in the photograph presented in FIG. 5. Upon washing, a nice adherent and smooth coating 250 was observed on the surface as seen in the photograph presented in FIG. 6. The uncoated portion of the substrate is identified as 252.

Based on the previous results, subsequent coating experiments were conducted using a melt or plating bath having a composition of LiBr—KBr—CsBr containing 80 wt. % $AlBr_3$. The subsequent coating experiments were conducted at different current densities and on various substrate materials. It is noted that dendrite formation was found to be significant up to 50 wt. % of $AlBr_3$ with less amounts of dendrites being seen at both 60 and 70 wt. % $AlBr_3$, and no dendrites were seen at 80 wt. % $AlBr_3$.

Finding 80 wt. % $AlBr_3$ to provide a desirable and satisfactory coating, a series of coating experiments were carried out at different current densities on a variety of materials and geometries. In conducting the tests, planar substrates were welded to a 3 mm stainless steel wire, which, in turn, acted as the current collector. Rod type substrates were held with a stainless steel cap and screw type arrangement and the cap, in turn, was connected to a stainless steel wire. Screws were threaded into a metallic cap (the type used for the rods) with a wire welded into it, which, in turn formed the current collector.

Starting with the planar structures, both SS316 and SS304 plates were tested using 80 wt. % $AlBr_3$ in the melt. In doing so, it was observed that by employing a combination of various conditions, it was possible to obtain smooth, adherent and thick aluminum coatings on different substrates. For example, it was observed that in situ cleaning of the electrodes by reversing the polarity prior to coating, a combination of deposition and stripping (by running open circuit potential from time to time), and the employment of pulsed deposition techniques helped to improve the quality of the coating.

The pulsed deposition technique was performed by two ways. In one approach, pulsed deposition included running the electroplating for a specific duration, pausing the electrolysis for some time, allowing the substrate to stay in the molten salt and then continuing the experiment for another specific duration. In another approach, pulsed deposition included coating the substrate for some time and then stripping the coating by reversing the polarity.

It was noted that at higher current density, the coated surface appeared to be more smooth while at lower current density the coating appeared somewhat grainy. Good quality coatings were observed in a current density range of approximately 0.1 $Acm^{-2}$ to approximately 0.5 $Acm^{-2}$. In most cases, a duration between 60-120 minutes total plating time (exclusive of cleaning and conditioning the cathode) produced nice adherent coatings. Although freshly prepared plating baths always provided good coatings, some of the better coatings could also be observed after the bath was topped up with the addition of fresh $AlBr_3$.

The loss of $AlBr_3$ content during the electro deposition process was calculated by taking the weight of the alumina crucible containing the electrolyte both before and after electroplating. As the percentage weight loss of the auxiliary electrolyte (eutectic LiBr—KBr—CsBr) was substantially less (e.g., 0.03-0.1 as shown in Table 1 above), it was assumed that the weight loss was primarily due to the loss of $AlBr_3$ by way of vaporization—the sublimation temperature of $AlBr_3$ being 268° C.

A general rising trend in the weight loss pattern was observed with respect to increased $AlBr_3$ content. The percent weight loss, after completion of a series of plating experiments, from the plating baths containing 10, 20, 40, 50 and 80 wt. % $AlBr_3$, was 1.24%, 2.6%, 0.908%, 1.45% and 4% respectively. It is noted that this is a significant advantage over chloride electrolytes where the reported loss of $AlCl_3$ has been reported to be very high (approximately 50 wt. %). A higher sublimation temperature of $AlBr_3$ over $AlCl_3$ (by a margin of 85° C.) and a higher density (by a factor 0.7) are believed to have minimized the loss of $AlBr_3$ in comparison to $AlCl_3$.

Further experiments addressed the electroplating of other base materials. For example, under conditions similar to that described above with respect to stainless steel plates, rods of various materials were used as a cathode or working electrode. One rod comprised mild steel, another comprised brass and yet another comprised copper. Fresh plating baths containing 80 wt. % $AlBr_3$ were used for processing of the rods. In comparison to use of planar electrodes (e.g., the stainless steel plates), the coating on rods, in general, was found to be improved in its smooth finish and its uniform application. When pulled out of the plating bath, the rods were found to have little salts deposited on them. The aluminum coating was observed to be shiny and adherent.

In the case of the copper rod, the deposition of the aluminum coating was carried out in two consecutive runs. The first deposition run was carried out at −2.0 A for a duration of 1 hour and the other run was carried out at −0.5 A for a duration of 40 minutes. In both the cases, similar voltage vs. time profile were obtained. As previously noted, a shiny, smooth and adherent aluminum coating was obtained.

Because screws, nuts and bolts are some of the complex surfaces that would be desirable to coat with aluminum (with SS fasteners being widely used in aerospace and shipping industries, and having been successfully coated with aluminum by hot plating/aqueous techniques), it was decided to examine if some of the these complex surfaces could be coated with aluminum using a process such as described herein. Three different complex structures were chosen for testing. These structures included a brass screw, a stainless steel screw, and a tool steel drill bit.

With regard to the brass screw, the entire cross section of the brass screw was coated with a homogeneous and shiny aluminum coating. Likewise, the stainless steel screw, processed under an applied current range of about 2-3 A, resulted in the tip and the threaded zones being covered with aluminum. The total duration of the plating experiment for the stainless steel screw was 60 minutes.

The tool-steel drill bit was yet another complex substrate taken up for electroplating to see if the helically fluted surface could be completely coated with aluminum. The plating, which was accomplished at −3.0 A for the duration of 100 minutes, completely covered the fluted surface features with smooth and shiny aluminum coating.

The coating on stainless steel and brass screws as well as on drill bit indicates that an all bromide plating bath can be used to provide smooth and adherent aluminum coating on complex substrates, such as steel fasteners.

The aluminum coating profiles on the SS 316 and 304 plates, mild steel, brass and copper rods were taken up for detailed morphology studies using scanning electron microscopy with energy dispersive X-ray spectroscopy (SEM-EDX) techniques. Coating sections were carefully cut with a low speed diamond wafering saw and the sectioned materials were mounted by potting them in a Buhler Epo-Heat thermosetting epoxy resin. The potted samples were loaded into a vacuum furnace to remove the residual air bubbles present in the uncured epoxy resin. The curing of the epoxy was carried out by heating it in a furnace up to a temperature of 60° C. for about 90 minutes. During curing the vent/air valve to the furnace was deliberately left open in order to ensure that the furnace chamber remains at atmospheric pressure. The mounted sections were then polished by a series of SiC papers (320, 400, 800 and 1200 grit), then by 3, 1, and 0.5 micron diamond paste with slurry, and finally by a gamma-alumina (0.05 micron) suspension. A thin platinum film was applied to the samples to render the samples with a desired level of conductivity suitable for examination under a scanning electron microscope.

Figure 7:
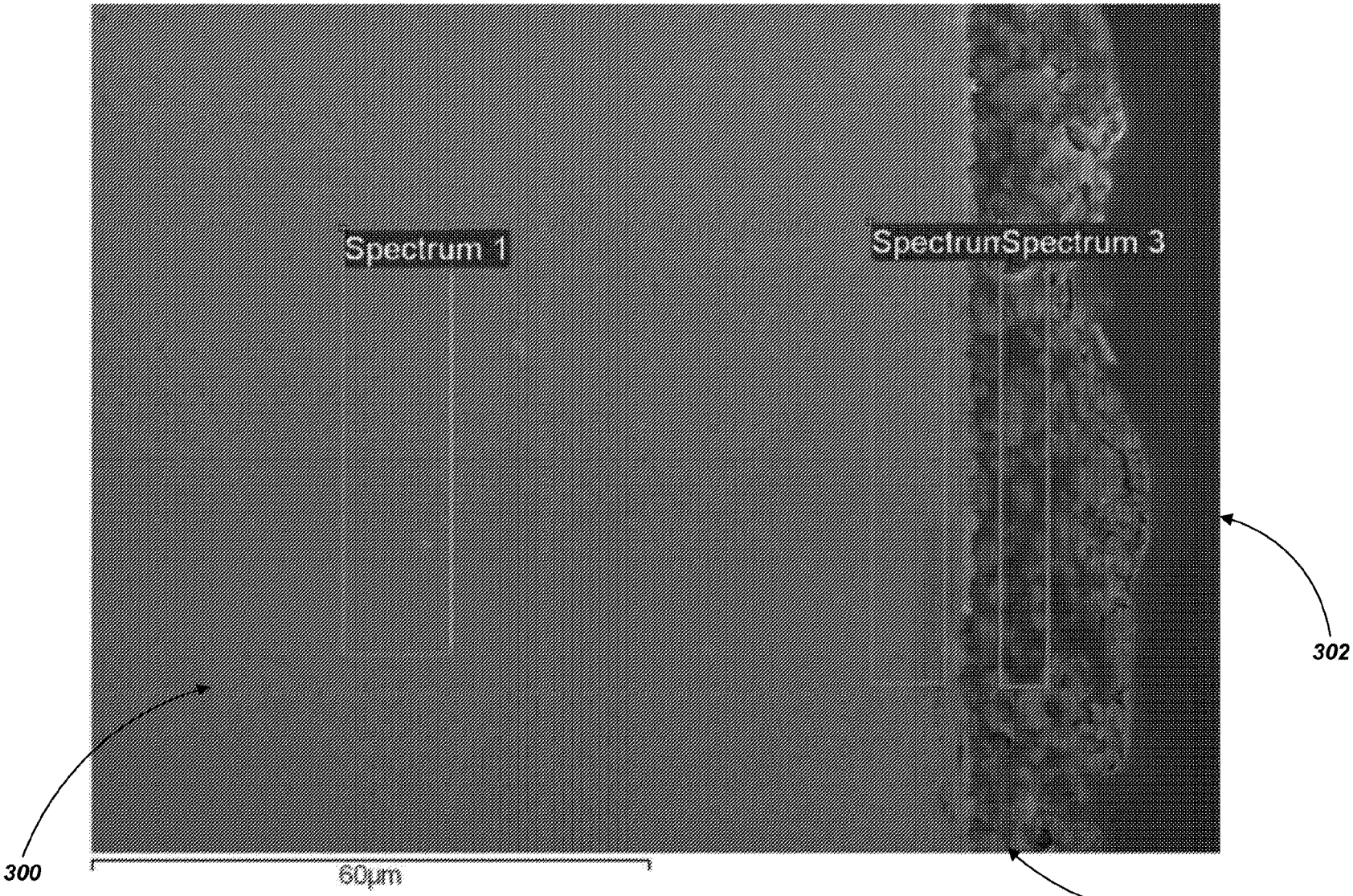
FIGS. 7 and 8 are scanning electron microscope images showing the morphology of an aluminum coating on a copper rod.
Figure 8:
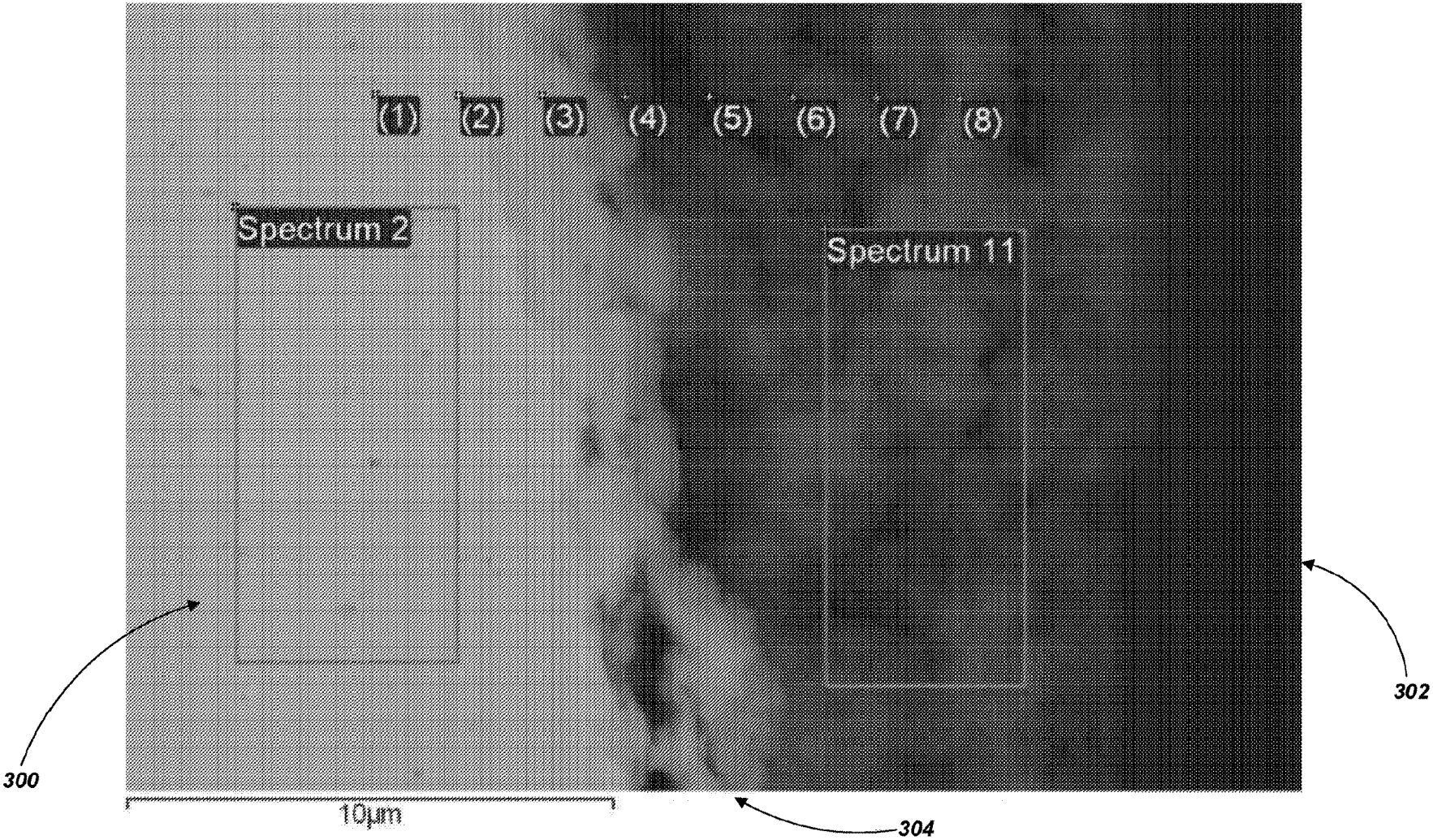

Considering first the copper rod, the morphology showed a very dense, and coherent aluminum deposit as shown in the image presented in FIG. 7. The elemental mapping showed a clear segregation of the substrate 300 from the coating 302. The morphology showed that an aluminum diffusion layer 304 was found to exist between the substrate 300 and the aluminum coating 302 as better seen in the image presented in FIG. 8. This indicates that aluminum diffused from the coating layer towards the substrate during the coating, providing a very strong bonding between the copper substrate and aluminum coating.

With regard to the aluminum coating on the brass rod, the coating while being adherent was found to contain some porosity. However, like in case of copper rod, the presence of an aluminum diffusion layer once again indicated strong bonding between the brass substrate and aluminum coating.

With regard to the aluminum coating on a mild steel rod, the morphology showed a dense, adherent and thick aluminum coating. However, unlike the morphology exhibited in both brass and copper rods, no aluminum interlayer between the substrate and coating was ascertained.

Regarding the aluminum coating on the SS316 plate, the aluminum formed a very dense and adherent coating. Also, the morphology indicated that there was good bonding between the coating and the substrate although diffusion of aluminum from the coating to the substrate was not observed.

In the case of the SS304 plate, the aluminum coating was found to have a certain porosity. Additionally, like in case of the SS316 plate, no diffusion of aluminum from the coating to the SS404 substrate was observed.

The coatings on the various substrates were also evaluated by subjecting the coating to a variety of corrosion tests under simulated conditions in an effort to determine the ultimate functionality under anticipated service conditions. Electrochemical techniques are well known to be viable methods for rapid prediction or evaluation of corrosion since most aqueous corrosion processes are associated with metals that involve charge/mass transfer reactions across the metal-solution interface.

The samples evaluated during the corrosion tests included the non-annealed SS316 plate, the SS304 plate and the coated tool steel drill bit as well as an annealed SS316 plate. The annealed SS316 plate was, after the formation of the aluminum coating, annealed in a furnace at a temperature of 600° C. in order to remove porosity. After the annealing process, the shiny aluminum coating became dull. Techniques that were employed for evaluating the preliminary corrosion resistance characteristics included immersion in 5% NaCl solution, OCP and polarization tests.

In regards to the first technique, an un-buffered 5% NaCl solution (20 mL) was used for all the immersion tests. This is one of the standards used for salt spray tests (although use of 3% NaCl solutions have been reported by some authors, it was preferred by the inventors to have a higher concentrated salt solution in the present evaluation studies) and serves as a preliminary evaluation of the protective nature of the Al coatings. To diminish any influence from regions not coated with aluminum, uncoated portions of the samples were covered with two layers of nail polish and allowed to dry prior to tests. Each sample was positioned in a vial such that the uncoated side (i.e., the side not having an aluminum coating) did not face the bulk of the solution. Due to microbial growth the solution was replaced the ninth day. The immersion chambers were sealed with parafilm to minimize solution evaporation.

Microscopic images of each immersed electrode were taken on the day on which the test was commenced, as well as 1, 2, 6, 10 and 14 days after commencement. Prior to imaging, the samples were rinsed with copious amounts of deionized water and then dried using $N_2$. After obtaining images the samples were re-immersed in the salt solution for further tests.

All Al-coated samples were found to provide good barrier protection to the underlying substrate. Near the end of the immersion test, a few of the un-coated areas of the stainless steel sample (i.e., areas lacking aluminum coating) were exposed and noticeable corrosion of stainless steel was observed in these areas within 2 days of the exposure to the salt solution. This was also true of the drill bit which showed a shift in the open circuit as corrosion progressed and which showed some corrosion after two days of immersion. The main corrosion mechanism of the coatings appears to be coupled with the pitting of the Al coating and subsequent growth of Al oxy-hydroxides and other insoluble Al compounds. This is typical for Al and Al alloys when immersed in a chloride ion environment. Both the SS316 and the SS304 samples showed significant amounts of growth over most of the exposed area of each respective sample. The drill bit sample had some distinct growth regions, but also had large areas devoid of growth which had a dimpled, reflective surface. These areas evolved over the course of the immersion test and became more reflective in the first 10 days of immersion. Little change in appearance occurred following day 10. Both the SS316 and 304 samples remained unaffected for 10 days.

Measurement of OCP is a simple technique employed to gain meaningful corrosion information. OCP of a corroding metal/alloy is measured as a voltage between the metal/alloy (working electrode) and a reference electrode using a high impedance voltmeter. Measurement of OCP can provide various information such as, but not limited to: (i) if the corrosion system is in the active or passive state; (ii) determination of potential distribution on the corroding surface (heterogeneous mixed electrodes); (iii) data for corrosion monitoring in a plant or in the field; and (iv)

information on the free corrosion potential as the starting point for the application of electrochemical protection methods.

Open circuit measurements were obtained using the drill bit and the annealed SS316 plate as the working electrode. An Ag/AgCl electrode was used as the reference electrode for the test. Roughly 1 cm of either the coated or uncoated end of the sample was immersed in the solution (20 mL of a 5% NaCl solution) maintaining the immersed portion in the center of the immersion vial. The reference electrode was placed in close proximity (within approximately 0.5 cm of the working electrode). To minimize evaporation of solution the immersion chamber was sealed using parafilm.

Open circuit measurements showed marked differences between the coated and uncoated ends of the drill bit. For the uncoated end of the drill bit, the open circuit quickly decayed to below −0.5 V vs Ag/AgCl within the first hour of exposure. For the Al-coated section, the open circuit started out more negative, but the OCP quickly increased before starting a gradual decrease over the remainder of the experiment. At the completion of the experiment the edges of the Al coated drill bit point showed some indication of Fe oxidation as evidenced by a distinct rust color. For non-edge surfaces the surface remained gray. For the uncoated end of the drill bit (which was exposed for 48 h to the salt solution), significant corrosion occurred with the formation of a thick brown-black film over the entire immersed surface.

Analysis of the OCP of various samples indicated that varying degrees of passivation/protection of the underlying substrate are exhibited. For the tool steel drill bit, both the native steel and the Al coated portions were tested. For two independent trials on the Al portion, the OCP initially started positive and then progressed to negative values before rebounding. Following the rebound a gradual decline in OCP was observed (to approximately −0.55 V). For the sake of comparison, the uncoated portion of the bit started positive, rapidly declined to about −0.55 V, followed by a gradual decline to near −0.6 V. It should be noted that $O_2$ reduction initiates at Fe surfaces near −0.5 V.

The final OCP measurement on the uncoated surfaces indicated a competition between $O_2$ reduction, which is facilitated by chloride ion ($Cl^-$) induced pitting, and Fe oxidation. The behavior of the Al-coated sample is considered to occur in a similar, but more complicated manner. A more stable and noble open circuit potential was obtained for the annealed sample indicating that post deposition annealing (to reduce the porosity, arising out of electrochemical formation of the coating) will further enhance the corrosion resistance characteristics.

With regard to the polarization procedure, the samples were polarized in the negative direction from open circuit followed by a positive excursion. The negative excursion served to look for $O_2$ reduction which initiates at different potentials on Al and Fe surfaces. A platinum mesh served as the counter electrode and a Ag/AgCl electrode was used as the reference electrode.

Polarization tests were performed on the annealed sample at two different points (at 24 and 96 hours) during the OCP measurement. Following each test the solution was exchanged with fresh 5% NaCl (20 mL). For both polarization tests little current is observed as the potential is driven negative to −1.0 V vs Ag/AgCl. This is expected for an Al surface. On the positive-going sweep an increase in current is again observed for both instances with the 24 hour run initiating at approximately −0.15 V and at approximately −0.25 V for the 96 hour run. Despite the small change in initiation voltage the second run maintained a lower total current for the duration of the experiment. The positive excursion in the current is attributed to the oxidation of $Al^{3+}$ which subsequently diffuses away from the surface. For both the immersion and polarization test, part of the electrode was masked using nail polish to protect the surface. Upon removal of the polish at the end of the experiments there was a clear delineation between the masked and the non-masked portion of the surface where clear removal of the Al-coating could be seen.

The aluminum coatings provided adequate protection for the conditions to which they were exposed. The experimental results indicate that either a sufficiently grown aluminum layer or a combination of an aluminum layer and an aluminum oxide layer ($Al_2O_3$) obtained from a bromide melt provides an effective solution to the mitigation of corrosion of metallic components. The samples indicate that embodiments of the present disclosure provides numerous advantages.

For example, the systems and methods of the present disclosure provide a relatively high sublimation temperature while density loss of $AlBr_3$ has been observed to be acceptably low. This is a significant advantage over, for example, an aluminum chloride melt as the loss of $AlCl_3$ during electroplating is as high as approximately 50%.

Additionally, comparatively higher plating temperatures used in certain embodiments of the present disclosure favors the formation of diffusion bonding by the formation of an aluminum interlayer. Formation of aluminum interlayer between the substrate and the aluminum coating promotes good adhesion/bonding of the coating with the substrate. It is noted that the coatings did not peel off when cut sections were mounted and polished for SEM-EDX characterization. Such an observation is not known as being reported to take place in association with coating formed from a chloride melt.

Further, embodiments of the present disclosure make it possible to obtain thick and dense coatings on various substrates and to provide complete aluminum coatings on substrates having complex or intricate geometrical designs. For example, coatings may be obtained that range in thickness up to several hundreds of millimeters.

Corrosion tests further indicated that post-coating annealing will further enhance the corrosion resistance characteristics of the aluminum coated substrates.

As previously discussed embodiments of the present disclosure may include a variety of base materials, including, for example, aluminum, aluminum alloys, zirconium, zirconium alloys (e.g., zircaloy 2/4, Zr—Nb), neodymium-iron-boron, nickel-titanium, copper, brass and other metals and metal alloys.

With respect to various materials, including zirconium based materials, it is believed that the Al coating helps to prevent or at least mitigate hydrogen embrittlement of the substrate material. It is also believed that with zirconium based materials, a diffused layer forms between the aluminum layer and the zirconium or zirconium alloy base material—such as been described hereinabove with respect to other materials.

In one example, zircaloy 2, zircaloy 4 and zirconium-1 wt. % niobium are used as cladding materials in light water nuclear reactors. These cladding materials, under a Loss of Coolant Accident (LOCA) scenario, can pose serious problems due to hydrogen embrittlement. Surface modification of these alloys by an aluminum coating treatment such as described hereinabove, may effectively mitigate such a problem. The zirconium present in these alloys will react with the aluminum to form a combination of metallic aluminum and zirconium aluminides. Formation of these layers on the cladding surface, may effectively prevent the passage of hydrogen gas and, as a result, zirconium, coated by the protective surface layers, will not be able to undergo hydrogen embrittlement reactions. Thus, the failure of the cladding material, under the LOCA scenario, may be mitigated.

In another example, neodymium-iron-boron forms an intermetallic magnetic phase ($Nd_2Fe_{14}B$). This phase is popularly known as neo magnet. These magnets are prone to oxidation at elevated temperatures. However, the functionality of this magnet can be protected by forming a thin nickel/copper/nickel-copper layer on the magnet surface. Aluminum can also form a very effective surface layer that can protect the magnet from the oxidation triggered degradation. Thus, neodymium-iron-boron may be coated with aluminum in accordance with processes described herein to protect the functionality of the resulting magnets and to inhibit or prevent oxidation.

In yet another example, nickel-titanium alloys may be coated in accordance with processes described herein. Nickel-titanium alloys are important biomaterials but the long-term use of these alloys in human body triggers preferential nickel leaching, which ultimately affects the mechanical integrity of these alloys. Degradation of these materials in the presence of bio-fluids may be prevented by way of providing an aluminum coating on its surface. Aluminum will form a series of alloys with both nickel and titanium. These surface (alloy) layers—or diffusion layers—will, in turn, help prevent the loss of nickel from the nickel-titanium alloys and make the nickel-titanium alloys more durable for bio-medical application.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A system, comprising:

a primary crucible containing a plating melt, the plating melt comprising a bromide salt mixture comprising $AlBr_3$ and a eutectic melt of first bromide salts, the first bromide salts comprising LiBr, KBr, and CsBr, wherein the bromide salt mixture is configured to have a melting temperature greater than 300° C.; and an electrode assembly comprising:

a working electrode configured to receive a metallic workpiece such that at least a portion of the metallic workpiece is disposed within the plating melt, and a counter electrode comprising aluminum.

2. The system of claim 1, wherein the plating melt comprises a homogeneous melt of AlBr3 and the first bromide salts.

3. The system of claim 1, further comprising a heating element configured to maintain a temperature of the plating melt within an operating temperature range between approximately 325° C. and 400° C.

4. The system of claim 1, wherein the plating melt is at least 10 percent AlBr3 by weight.

5. The system of claim 1, wherein the plating melt is approximately 80 percent $AlBr_3$ by weight.

6. The system of claim 1, further comprising:

a heater operably coupled to the primary crucible;

wherein a homogenous melt of the first bromide salts and the $AlBr_3$ is produced by raising a temperature of the mixture of the first bromide salts and the $AlBr_3$ to a homogeneous melt temperature.

7. The system of claim 1, further comprising:

a heater operably coupled to the primary crucible;

wherein the plating melt is prepared by:

producing a first melt product, comprising raising a temperature of the first bromide salts to a eutectic melt temperature configured to produce a eutectic melt of the first bromide salts prior to incorporation of the $AlBr_3$; and producing a homogeneous melt of the first bromide salts and the $AlBr_3$ in response to incorporation of the $AlBr_3$ into the first melt product, the $AlBr_3$ incorporated in response to a temperature of the first melt product falling to a baseline temperature lower than the eutectic melt temperature.

8. The system of claim 7, further comprising:

a cooling system;

wherein preparing the plating melt further comprises reducing the temperature of the first melt product in response to maintaining the first bromide salts at the eutectic melt temperature for a determined time.

9. The system of claim 1, further comprising a heater, wherein preparing the plating melt comprises:

maintaining a temperature of the mixture comprising the first bromide salts and the $AlBr_3$ at an intermediate temperature for a determined time period; and raising the temperature of the mixture from the intermediate temperature to a homogeneous melt temperature in response to maintaining the mixture at the intermediate temperature for the determined time period, wherein the homogeneous melt temperature is between about 550° C. and about 750° C.

10. The system of claim 9, wherein:

the mixture comprises a powdered salt mixture, the determined time period is about an hour, and the intermediate temperature is about 150° C.

11. The system of claim 1, further comprising:

a furnace well;

a secondary crucible positioned within a lower interior portion of the furnace well, wherein the primary crucible is disposed on a support member configured to position the primary crucible at least partially within an interior volume of the secondary crucible, and wherein the primary crucible is electrically insulated from the secondary crucible;

a first heat baffle positioned between the lower interior portion of the furnace well and an upper interior portion of the furnace well; and a second heat baffle located above the upper interior portion of the furnace well.

12. The system of claim 1, further comprising:

a temperature measurement device configured to measure a temperature of contents of the primary crucible; and an electrical power supply operably coupled to the electrode assembly.

13. The system of claim 12, wherein the temperature measurement device comprises a thermocouple, and wherein the electrical power supply comprises one or more of a potentiostat and a direct current power supply unit.

14. The system of claim 1, further comprising;

a potentiostat configured to apply a voltage to the electrode assembly; and a control device configured to control the voltage applied by the potentiostat.

15. The system of claim 14, wherein the electrode assembly further comprises a reference electrode, and wherein the potentiostat is configured to control a voltage difference applied between the working electrode and the reference electrode.

16. The system of claim 1, wherein the workpiece comprises one or more of stainless steel, mild steel, tool steel, aluminum, zirconium, neodymium-iron-boron, nickel-titanium, copper, and brass.

17. A system, comprising:

a primary crucible containing a plating bath, the plating bath comprising a melt of an electrolyte salt mixture, the electrolyte salt mixture comprising aluminum bromide and eutectic salts, the eutectic salts comprising lithium bromide, potassium bromide, and cesium bromide, wherein a melting temperature of the electrolyte salt mixture is greater than about 300° C.;

a heating element configured to maintain the plating bath at an electroplating temperature; and an electrode assembly comprising:

a working electrode configured to position a metallic workpiece such that at least a portion of a surface of the metallic workpiece is in contact with the plating bath, and a counter electrode comprising aluminum.

18. The system of claim 17, wherein the electrolyte salt mixture is at least 10% aluminum bromide by weight.

19. The system of claim 18, wherein producing the plating bath comprises:

heating a first mixture of the lithium bromide, potassium bromide and cesium bromide to about 750° C., wherein the aluminum bromide is added to the first mixture to produce a second mixture responsive to cooling the first mixture to about 100° C.; and heating the second mixture to the electroplating temperature to produce the plating bath, the electroplating temperature between about 325° C. and about 400° C.

20. The system of claim 17, wherein the plating bath comprises a homogeneous melt of the aluminum bromide and the eutectic salts.

21. The system of claim 17, wherein the plating bath is at least 80 percent aluminum bromide by weight.

22. An electroplating apparatus, comprising:

an electrolyte composition comprising aluminum bromide and a eutectic mixture comprising lithium bromide, potassium bromide, and cesium bromide, wherein the electrolyte composition comprises between 10% and 90% aluminum bromide by weight and has a melting temperature above about 300° C.;

a primary crucible comprising a melt of the electrolyte composition;

a working electrode configured to position a metallic workpiece such that at least a portion of the metallic workpiece is disposed within the melt of the electrolyte composition; and a counter electrode comprising aluminum.

23. A system, comprising:

a plating bath comprising a melt of an electrolyte salt comprising aluminum bromide and a eutectic composition comprising lithium bromide, potassium bromide, and cesium bromide, the electrolyte salt having a melting temperature greater than about 300° C.;

a working electrode configured to hold a metallic workpiece such that at least a portion of the metallic workpiece is submerged within the plating bath; and a counter electrode comprising aluminum.

24. An apparatus, comprising:

an electroplating bath comprising a eutectic melt of an electroplating salt, the electroplating salt having a melting temperature of at least about 300° C. and comprising a plurality of bromides, the plurality of bromides including aluminum bromide, lithium bromide, potassium bromide, and cesium bromide;

a first electrode configured to hold an object such that at least a portion of the object is disposed within the electroplating bath; and a second electrode.

25. The apparatus according to claim 24, wherein the electroplating salt is at least 10% aluminum bromide by weight.

26. The apparatus according to claim 24, wherein the electroplating salt is at about 80% aluminum bromide by weight.

27. The apparatus according to claim 24, wherein the electroplating salt comprises a eutectic melt of the lithium bromide, potassium bromide, and cesium bromide.

28. The apparatus according to claim 24, wherein the electroplating bath comprises a homogeneous melt of the plurality of bromides.

29. The apparatus according to claim 24, wherein the second electrode comprises one of a reference electrode and a counter electrode comprising aluminum.

30. The apparatus according to claim 24, further comprising;

a heater configured to heat the electroplating bath; and an electrical power supply;

wherein implementing a cycle of a pulsed deposition operation comprises:

applying a first voltage differential between the first electrode and the second electrode for a first time period, applying a second voltage differential between the first electrode and the second electrode for a second time period following the first time period, the second voltage differential different from the first voltage differential, and maintaining a temperature of the electroplating bath within an electroplating temperature range during the first time period and the second time period.

31. The apparatus according to claim 30, wherein the second voltage differential is substantially zero.

32. The apparatus according to claim 30, wherein a polarity of the second voltage differential is a reverse of a polarity of the first voltage differential.

33. The apparatus according to claim 30, wherein the electroplating temperature range is between about 325° C. and about 400° C.

* * * * *